US006677899B1

(12) United States Patent
Lee et al.

(10) Patent No.: US 6,677,899 B1
(45) Date of Patent: Jan. 13, 2004

(54) LOW COST 2-D ELECTRONICALLY SCANNED ARRAY WITH COMPACT CTS FEED AND MEMS PHASE SHIFTERS

(75) Inventors: Jar J. Lee, Irvine, CA (US); Clifton Quan, Arcadia, CA (US); Brian M. Pierce, Moreno Valley, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/373,941

(22) Filed: Feb. 25, 2003

(51) Int. Cl.[7] ..... H01Q 3/00

(52) U.S. Cl. ..... 342/376; 342/372; 343/753; 343/754

(58) Field of Search ..... 342/368, 369, 342/372, 376; 343/753, 754, 909

(56) References Cited

U.S. PATENT DOCUMENTS 5,359,338 A * 10/1994 Hatcher, Jr. et al. ..... 343/778
6,160,519 A * 12/2000 Hemmi ..... 343/754
6,421,021 B1 * 7/2002 Rupp et al. ..... 343/753

* cited by examiner

*Primary Examiner*—Theodore M. Blum
(74) *Attorney, Agent, or Firm*—Leonard A. Alkov; Glenn H. Lenzen, Jr.

(57) ABSTRACT

A microelectromechanical system (MEMS) steerable electronically scanned lens array (ESA) antenna and method of frequency scanning are disclosed. The MEMS ESA antenna includes a MEMS E-plane steerable lens array and a MEMS H-plane steerable linear array. The MEMS E-plane steerable lens array includes first and second arrays of wide band radiating elements, and an array of MEMS E-plane phase shifter modules disposed between the first and second arrays of radiating elements. The MEMS H-plane steerable linear array includes a continuous transverse stub (CTS) feed array and an array of MEMS H-plane phase shifter modules at an input of the CTS feed array. The MEMS H-plane steerable linear array is disposed adjacent the first array of radiating elements of the MEMS E-plane steerable lens array for providing a planar wave front in the near field. The H-plane phase shifter modules shift RF signals input into the CTS feed array based on the phase settings of the H-plane phase shifter modules, and the E-plane phase shifter modules steer a beam radiated from the CTS feed array in an E-plane based on the phase settings of the E-plane phase shifter modules.

17 Claims, 8 Drawing Sheets

LOW COST 2-D ELECTRONICALLY SCANNED ARRAY WITH COMPACT CTS FEED AND MEMS PHASE SHIFTERS

TECHNICAL FIELD

The present invention relates generally to electronically scanned antennas and, more particularly, to an electronic scanned antenna with a microelectromechanical system (MEMS) radio frequency (RF) phase shifter.

BACKGROUND OF THE INVENTION

Advanced airborne and space based radar systems heretofore have used electronically scanned antennas (ESA) including thousands of radiating elements. For example, large fire control radars which engage multiple targets simultaneously may use ESAs to provide the required power aperture product.

Space based lens architecture is one approach to realizing ESA for airborne and space based radar systems. However, when the space based lens architecture is utilized at higher frequencies, for example, the X-band, and more active components such as phase shifters are packaged within a given area, weight, increased thermal density, and power consumption may deleteriously affect the cost and applicability of such systems.

Heretofore, phase shifter circuits for electronically scanned lens array antennas have included ferrites, PIN diodes and FET switch devices. These phase shifters are heavy, consume a considerable amount of DC power, and are expensive. Also, the implementation of PIN diodes and FET switches into RF phase shifter circuitry is complicated by the need of an additional DC biasing circuit along the RF path. The DC biasing circuit needed by PIN diodes and FET switches limits the phase shifter frequency performance and increases RF losses. Populating the ESA with presently available transmit/receive (T/R) modules is undesirable due to high costs, poor heat dissipation and inefficient power consumption. In sum, the weight, cost and performance of available phase shifter circuits fall short of what is needed for space based radar and communication ESA's, where thousands of these devices are used.

SUMMARY OF THE INVENTION

The present invention provides a microelectromechanical system (MEMS) steerable electronically scanned lens array (ESA) antenna. According to an aspect of the invention, the MEMS ESA antenna is steerable in the E-plane using MEMS phase shifter modules, and steerable in the H-plane using MEMS phase shifter modules. The MEMS ESA antenna includes a MEMS E-plane steerable lens array and a MEMS H-plane steerable linear array. The MEMS E-plane steerable lens array includes first and second arrays of wide band radiating elements, and an array of MEMS E-plane phase shifter modules disposed between the first and second arrays of radiating elements. The MEMS H-plane steerable linear array includes a continuous transverse stub (CTS) feed array and an array of MEMS H-plane phase shifter modules at an input of the CTS feed array. The MEMS H-plane steerable linear array is disposed adjacent the first array of radiating elements of the MEMS E-plane steerable lens array for providing a planar wave front in the near field. The H-plane phase shifter modules shift RF signals input into the CTS feed array based on the phase settings of the H-plane phase shifter modules, and the E-plane phase shifter modules steer a beam radiated from the CTS feed array in an E-plane based on the phase settings of the E-plane phase shifter modules.

According to another aspect of the invention, there is provided a method of frequency scanning radio frequency energy, comprising the steps of inputting radio frequency (RF) energy into an array of MEMS H-plane phase shifter modules; adjusting the phase of the RF energy based on the phase settings of the MEMS H-plane phase phase shifter modules; radiating the H-plane phase adjusted RF signals through a plurality of CTS radiating elements in the form of a plane wave in the near field; emitting the H-plane phase adjusted RF plane wave into an input aperture of a MEMS E-plane steerable lens array including an array of MEMS E-plane phase shifter modules; converting the RF plane wave into discrete RF signals; adjusting the phase of the discrete RF signals based on the phase settings of the MEMS E-plane phase shifter modules; and radiating the H-plane and E-plane adjusted RF signals through a radiating aperture of the MEMS E-plane steerable lens array, thereby recombining the RF signals and forming an antenna beam.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1:
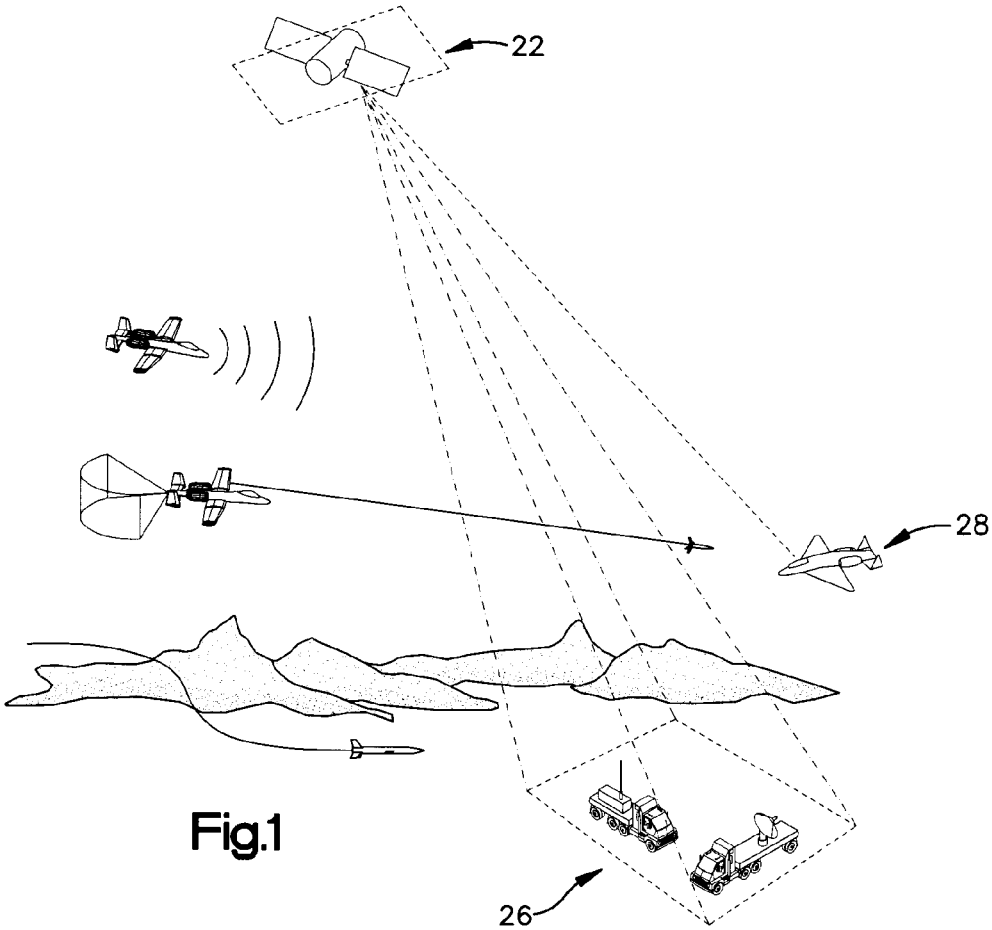
FIG. 1 is a schematic environmental view of several radar applications embodying an electronically scanned lens array (ESA) antenna with microelectromechanical system (MEMS) phase shifters in accordance with the present invention.

In the detailed description which follows, identical components have been given the same reference numerals, regardless of whether they are shown in different embodiments of the present invention. To illustrate the present invention in a clear and concise manner, the drawings may not necessarily be to scale and certain features may be shown in somewhat schematic form.

Figure 2:
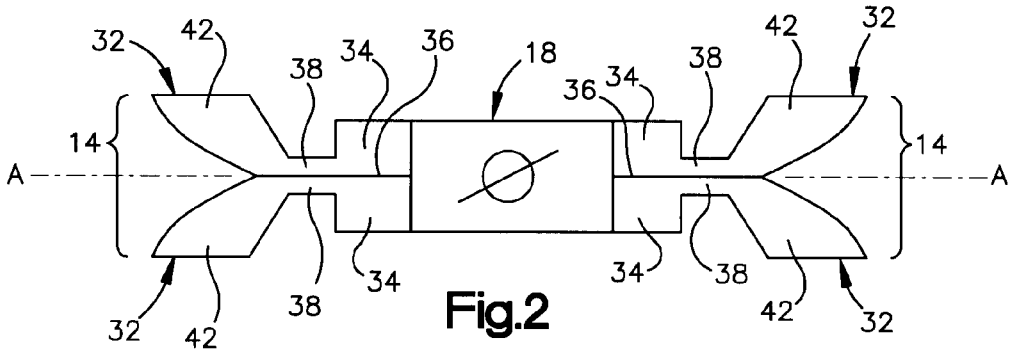
FIG. 2 illustrates a top plan view of a pair of wide band radiating elements and a MEMS phase shifter module in accordance with the present invention.
Figure 3:
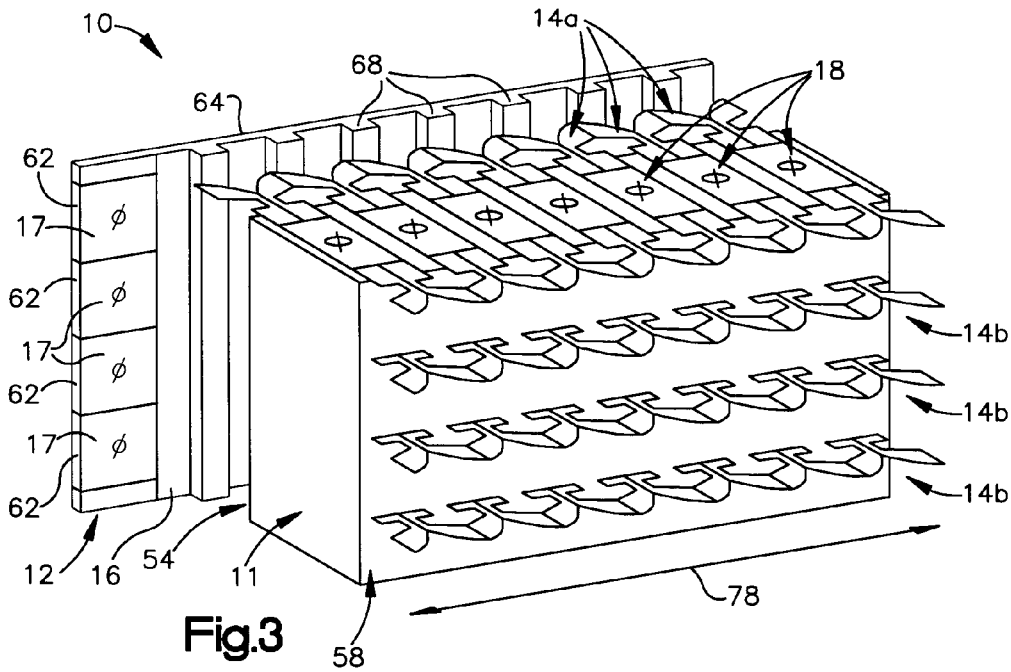
FIG. 3 illustrates a two dimensional microelectromechanical system (MEMS) steerable electronically scanned lens array antenna in accordance with the present invention, the lens antenna including a one dimensional MEMS E-plane steerable lens array and a one dimensional MEMS H-plane steerable continuous transverse stub (CTS) electronically scanned feed array.

Referring initially to FIGS. 1–3, the present invention is a two dimensional microelectromechanical system (MEMS) steerable electronically scanned lens array antenna 10 (FIG. 3) including a one dimensional MEMS E-plane steerable lens array 11 and a one dimensional MEMS H-plane steerable continuous transverse stub (CTS) electronically scanned feed array 12. The MEMS steerable lens array 11 includes a rear array of wide band radiating elements 14*a*, a front array of wide band radiating elements 14*b*, and an array of MEMS phase shifter modules 18 (FIG. 2) sandwiched between the rear and front arrays of radiating elements 14*a* and 14*b*. The MEMS steerable CTS 12 includes a CTS feed array 16 and a row of MEMS phase shifter modules 17 at the input of the CTS feed array 16. The phase shifter modules 17 allow the CTS feed array 16 to electronically scan in one dimension in the H-plane. The MEMS steerable CTS 12 is positioned adjacent the rear array of radiating elements 14*a* of the MEMS steerable lens array 11 and provides a planar wave front in the near field. The MEMS phase shifter modules 18 of the MEMS steerable lens array 11 steer a beam radiated from the MEMS steerable CTS 12 in one dimension in the E-plane. E-plane steering may also or alternatively be accomplished by varying the frequency, which causes the respective phases of the MEMS steerable CTS 12 to change, thereby to move the antenna beam to a different angular position along the E-plane.

As will be appreciated, the present invention obviates the need for transmission lines, power dividers, and interconnects that are customarily associated with corporate fed antennas. Also, the present invention reduces the number of control DC bias lines routed to the MEMS steerable lens array 11, which can become expensive and complex for large (where N>100) antenna array systems.

The antenna 10 is suitable in both commercial and military applications, including for example, aerostats, ships, surveillance aircraft, and spacecraft. FIG. 1 shows an environmental view of several advanced airborne and space based radar systems in which the antenna 10 may be suitably incorporated. These systems include, for example, lightweight X-band space-based radar for synthetic aperture radar (SAR) systems 22, ground moving target indication (GMTI) systems 26, and airborne moving target indication (AMTI) systems 28. These systems use a substantial number of antennas, and the antenna 10 of the present invention by means of the MEMS phase shifter modules 18 has been found to have a relatively lower cost, use relatively less power, and be lighter in weight than prior art antennas using PIN diode and FET switch phase shifters or transmit/receive (T/R) modules.

As is shown in FIG. 2, each MEMS phase shifter modules 17 and 18 is sandwiched between a pair of opposite facing wide band radiating elements 14. In the illustrated embodiment, the radiating elements 14 have substantially the same geometry and are disposed symmetrically about the MEMS phase shifter module 18 and about an axis A representing the feed/radiating direction through the antenna 10 and more particularly through the MEMS phase shifter module 18 thereof. As will be appreciated, alternatively the radiating elements 14 may have a different geometry and/or be disposed asymmetrically about the MEMS phase shifter module 18 and/or the feed/radiating axis A. In other words, the front or output radiating element 14*b* may have a different geometry than the rear or input radiating element 14*a*.

Each wide band radiating element 14 includes a pair of claw-like projections 32 having a rectangular base portion 34, a relatively narrower stem portion 38, and an arcuate distal portion 42. The claw-like projections 32 form slots 36 therebetween that provide a path along which RF energy propagates (for example, in the direction of the feed/radiating axis A) during operation of the antenna 10. The base portions 34, also referred to herein as ground planes, are adjacent one another about the feed/radiating axis A and adjacent the phase shifter module 18 at opposite ends of the phase shifter module 18 in the direction of the feed/radiating axis A. Together the base portions 34 have a width substantially the same as the width of the MEMS phase shifter module 18. The stem portions 38 are narrower than the respective base portions 34 and project from the base portions 34 in the direction of the feed/radiating axis A and are also adjacent one another about the feed/radiating axis A. The arcuate distal portions 42 project from the respective stem portions 38 in the direction of the feed/radiating axis A and branch laterally away from the feed/radiating axis A and away from one another. The arcuate distal portions 42 together form a flared or arcuate V-shaped opening that flares outward from the phase shifter module 18 in the direction of the feed/radiating axis A. The flared opening of a wide band radiating element 14 at the rear end of the MEMS steerable lens array 11 receives and channels radio frequency (RF) energy from the MEMS steerable CTS 12, and propagates the RF energy along the corresponding slot 36 to the corresponding MEMS phase shifter module 18. The flared opening of a wide band radiating element 14 at the opposite or front end of the MEMS steerable lens array 11 radiates RF energy from the corresponding MEMS phase shifter module 18 along the corresponding slot 36 and into free space.

Figure 4:
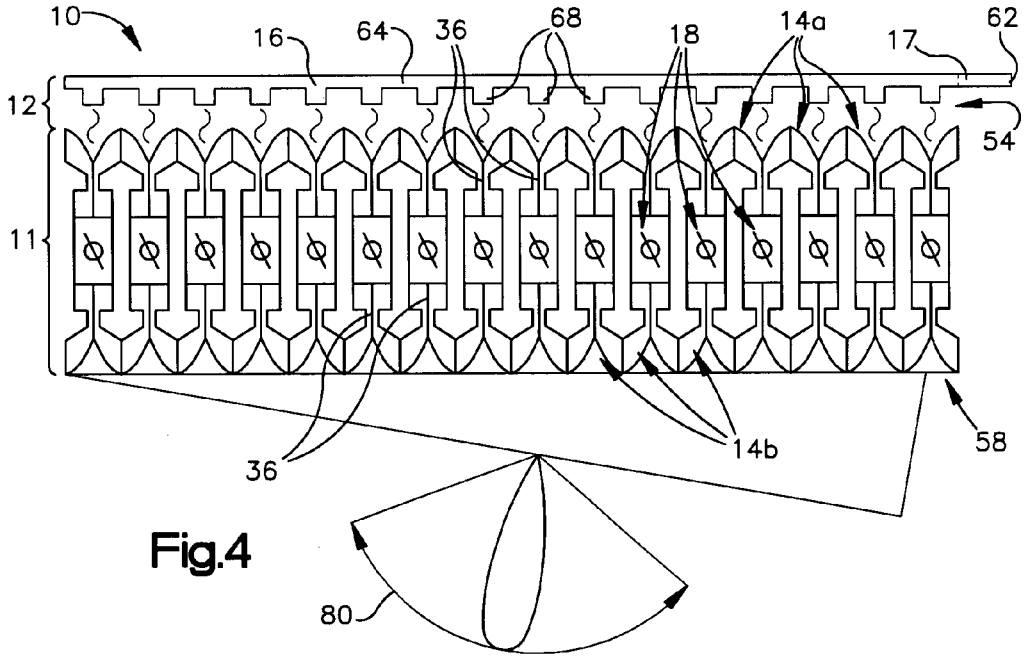
FIG. 4 is a top plan view of the FIG. 3 electronically scanned lens array antenna, except that the FIG. 4 lens antenna has 16 MEMS phase shifter modules and CTS radiating elements.

Turning to FIG. 3, the MEMS phase shifters 18 are configured as an array in the MEMS steerable lens array 11. Thus, the MEMS steerable lens array 11 includes an input aperture 54 comprising an array of input radiating elements 14*a* behind the MEMS phase shifters 18, and an output or radiating aperture 58 comprising an array of output radiating elements 14*b* in front of the MEMS phase shifters 18. The MEMS steerable lens array 11 of FIG. 3 has an array of four (4) rows and seven (7) columns of MEMS phase shifters 18 and four (4) rows and seven (7) columns of input and output radiating elements 14*a* and 14*b*. It will be appreciated that the array may comprise any suitable quantity of MEMS phase shifters 18 and input and output radiating elements 14*a* and 14*b* as may be desirable for a particular application. For example, in FIG. 4, the MEMS steerable lens array 11 includes sixteen MEMS phase shifters 18 and sixteen input and output wide band radiating elements 14*a* and 14*b*.

The MEMS steerable lens array 11 is space fed by the MEMS steerable CTS 12. The MEMS steerable CTS 12, illustrated in FIGS. 3 and 4, includes the plurality of MEMS phase shifter modules 17 (four in the FIG. 3 embodiment), a plurality of RF inputs 62 (four in the FIG. 3 embodiment), and the CTS feed array 16. The CTS feed array 16 includes a continuous stub 64 and a plurality of CTS radiating elements 68 projecting from the continuous stub 64 toward the input aperture 54 of the MEMS steerable lens array 11. In the illustrated embodiment, the CTS radiating elements 68 correspond in quantity to the input and output radiating elements 14*a* and 14*b*. Also, in the illustrated embodiment, the CTS radiating elements 68 are transversely spaced apart substantially the same distance as the transverse spacing between the input radiating elements 14*a* and the transverse spacing between the output radiating elements 14*b*. It will be appreciated that the spacing between the CTS radiating elements 68 need not be the same as or correspond to the spacing between the input radiating elements 14*a*. Moreover, it will be appreciated that the CTS radiating elements 68 (that is, the columns) and/or the MEMS phase shifter modules 17 and/or the RF inputs 62 (that is, the rows) of the MEMS steerable CTS 12 need not be the same and/or align with or correspond to the columns and rows of the input and output radiating elements 14*a* and 14*b* and/or the MEMS phase shifter modules 18 of the MEMS steerable lens array 11. Thus, the MEMS steerable CTS 12 may have more or fewer rows and/or columns than the MEMS steerable lens array 11 depending on, for example, the particular antenna application.

Figure 5:
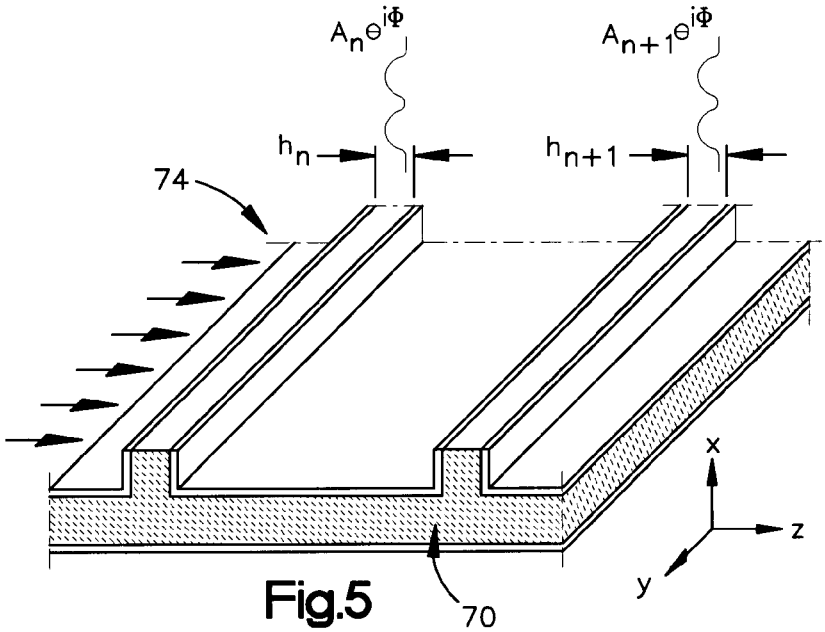
FIG. 5 is a cross-sectional view of a segment of the continuous transverse stub (CTS) electronically scanned feed array of FIG. 3.

FIG. 5 is a cross-sectional view of a segment of the MEMS steerable CTS 12 of FIG. 3. The MEMS steerable CTS 12 includes a dielectric 70 that is made of plastic such as rexolite or polypropylene, and is machined or extruded to the shape shown in FIG. 5. The dielectric 70 is then metallized with a metal layer 74 to form the continuous stub 64 and CTS radiating elements 68. The MEMS steerable CTS 12 lends itself to high volume plastic extrusion and metal plating processes that are common in automotive manufacturing operations and, accordingly, facilitates low production costs.

The MEMS steerable CTS 12 is a microwave coupling/radiating array. As is shown in FIG. 5, incident parallel waveguide modes launched via a primary line feed of arbitrary configuration have associated with them longitudinal electric current components interrupted by the presence of the continuous stub 64, thereby exciting a longitudinal, z-directed displacement current across the stub/parallel plate interface. This induced displacement current in turn excites equivalent electromagnetic waves traveling in the continuous stub 64 in the x direction to the CTS radiating elements 68 into free space. It has been found that such CTS nonscanning antennas may operate at frequencies as high as 94 GHz. For further details relating to an exemplary CTS feed array reference may be had to U.S. Pat. Nos. 6,421,021; 5,361,076; 5,349,363; and 5,266,961, all of which are hereby incorporated herein by reference in their entireties.

In operation, RF energy is series fed from the RF input 62 into the MEMS H-plane phase shifter modules 17 and then to the CTS radiating elements 68 via the parallel plate waveguide of the MEMS steerable CTS 12. The H-plane phase adjusted RF signals are then radiated out through the CTS radiating elements 68 in the form of a plane wave in the near field. It is noted that the distances that the RF energy travels from the RF input 62 to the CTS radiating elements 68 are not equal. The RF plane wave is emitted into the input aperture 54 of the MEMS steerable lens array 11 by the CTS radiating elements 68 and then converted into discrete RF signals. The RF signals are then processed by the MEMS E-plane phase shifter modules 18 to effect E-plane scanning in a manner more fully described below. For further details relating to an MEMS phase shifter reference may be had to U.S. Pat. Nos. 6,281,838; 5,757,379; and 5,379,007, all of which are hereby incorporated herein by reference in their entireties.

The MEMS processed signals are then re-radiated out through the radiating aperture 58 of the MEMS steerable lens array 11, which then recombines the RF signals and forms the steering antenna beam. For such a series fed MEMS steerable CTS 12, the antenna beam moves at different angular positions along the E-plane 78 (FIG. 3) as a function of frequency, as is illustrated for example at reference numeral 80 in FIG. 4. As the frequency varies, the output phase of each CTS radiating element 68 changes at different rates resulting in frequency scanning in the E-plane. Thus, the antenna is E-plane steerable by means of frequency variation and phase shifting.

In an alternative embodiment, a wide band frequency is achieved by feeding the CTS radiating elements 68 in parallel using a corporate parallel plate waveguide feed (not shown). By parallel feeding the CTS radiating elements 68, the distances that the RF energy travels from the RF input 62 to the CTS radiating elements 68 are equal. As the frequency varies, the output phase of each CTS radiating element 68 changes at substantially the same rate, and thus the antenna beam radiated out through the radiating aperture 58 remains in a fixed position.

Figure 6:
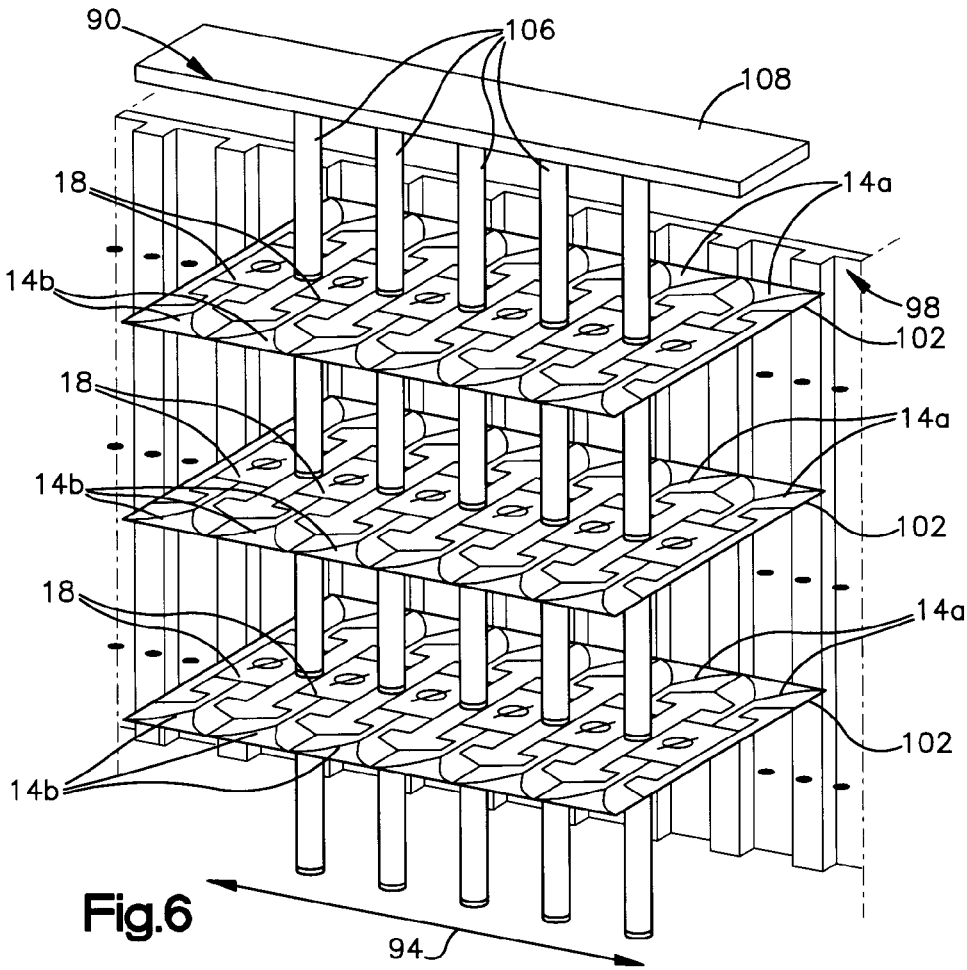
FIG. 6 is a schematic diagram showing a one dimensional MEMS E-plane steerable lens array including column control of MEMS phase shifters to accomplish E-plane scanning in accordance with the present invention.
Figure 7:
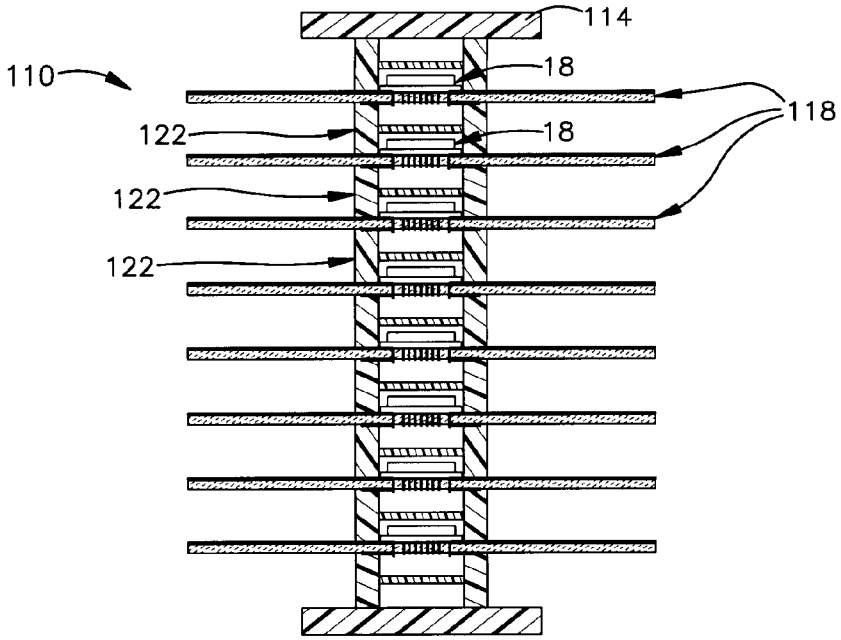
FIG. 7 is a side elevational view of a MEMS steerable electronically scanned lens array antenna in accordance with the present invention, the antenna including a printed wiring board (PWB), a plurality of phase shifter PCB assemblies, and a plurality of spacers containing DC column interconnects.
Figure 8:
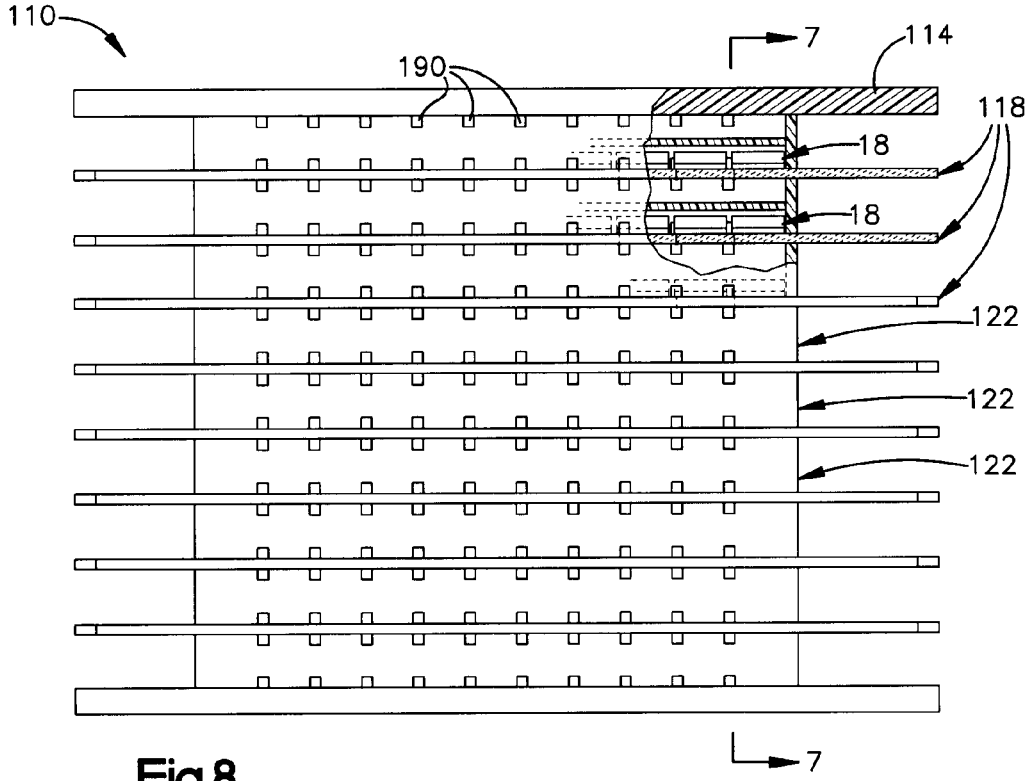
FIG. 8 is a front aperture view of the FIG. 7 MEMS steerable electronically scanned lens array antenna in accordance with the present invention.

FIG. 6 is a schematic diagram showing a one dimensional MEMS E-plane steerable lens array 90 including column control of MEMS phase shifters to accomplish E-plane scanning in accordance with the present invention. In FIG. 6, the arrow 94 represents E-plane scanning. A CTS feed array 98 for H-plane steering is shown in the background of FIG. 6 behind the MEMS steerable lens array 90. The MEMS steerable lens array 90 includes three rows of phase shifter modules 18 and radiating elements 14*a* and 14*b* mounted on respective printed circuit boards (PCBs) 102, and five lens column supports 106 each including a phase shifter biasing line and each maintaining the lattice arrangement of the rows of phase shifter modules 18 and radiating elements 14*a* and 14*b*. The biasing lines along or within each column support 106 are connected to a printed wiring board (PWB) 108, for example, at the top of FIG. 6, which in turn is connected to a beam steering computer and power supplies (not shown). The control circuitry biases each column of phase shifter modules 18 to effect the aforementioned E-plane scanning. More specifically, each column of phase shifter modules 18 is controlled together as a group so that each phase shifter module 18 along the column receives the same phase setting from the respective biasing line along the respective lens column support 106, while the next or adjacent column of phase shifter modules 18 are subjected to a different phase setting (for example, by a phase progression), by the next or adjacent lens column support 106.

FIGS. 7–14 show an exemplary embodiment of a MEMS steerable electronically scanned lens array antenna 110 realizing column control of MEMS phase shifters 18 in accordance with the present invention. The MEMS steerable antenna 110 includes a DC distribution printed wiring board (PWB) 114, a plurality of phase shifter printed circuit board (PCB) assemblies 118, and a plurality of spacers 122 for providing structural support to the MEMS steerable antenna 110 and for routing DC column interconnects and biasing lines.

Figure 9:
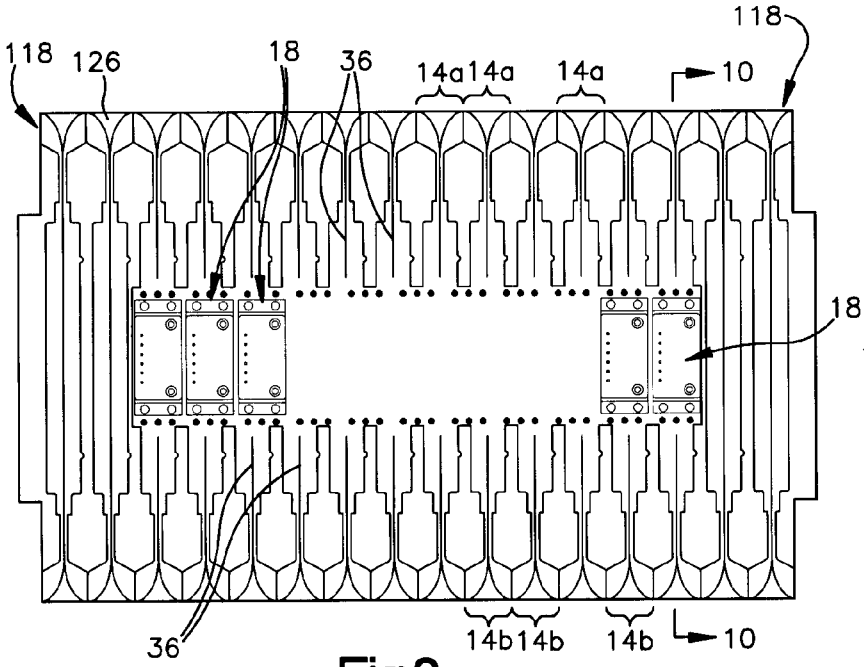
FIG. 9 illustrates a printed circuit board (PCB) of the FIG. 7 MEMS steerable electronically scanned lens array antenna, including an array of printed wide band radiating elements, and an array of MEMS phase shifter modules on the PCB in accordance with the present invention.

Each PCB assembly 118 includes a printed circuit board (PCB) 126 and an array of wide band radiating elements 14*a* and 14*b* and MEMS phase shifter modules 18. As is shown in FIG. 9, the wide band radiating elements 14*a* and 14*b* are fabricated onto the PCB 126, and the MEMS phase shifter modules 18 are mounted to the PCB 126 between the input and output radiating elements 14*a* and 14*b*. Each MEMS phase shifter module 18 includes a housing 130 (FIG. 12) made of kovar, for example, and a suitable number of MEMS phase shifter switches (not shown), for example two, mounted into the housing 130. It will be appreciated that the number of MEMS phase shifter switches will depend on the particular application.

Figure 10:
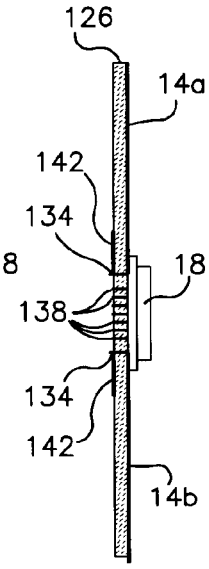
FIG. 10 is a side elevational view of the FIG. 9 PCB and MEMS phase shifter modules as viewed from the line 10—10 in FIG. 9.
Figure 11:
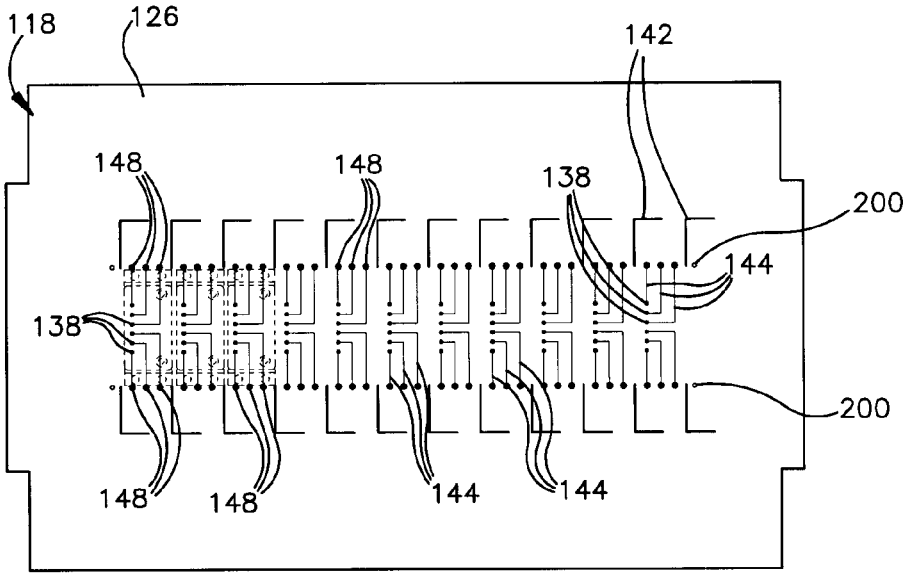
FIG. 11 is a bottom view of the FIG. 9 PCB and MEMS phase shifter modules.

A pair of RF pins 134 and a plurality of DC pins 138 protrude from the bottom of the housing 130 in a direction substantially normal to the plane of the housing 130 (FIG. 10). The RF pins 134 correspond to the respective input and output radiating elements 14*a* and 14*b*. The RF pins 134 extend through the thickness of the PCB 126 in a direction normal to the plane of the PCB 126, and are electrically connected to respective microstrip transmission lines 142 (that is, a balun) that are mounted on the PCB 126 on the side opposite to that which the RF MEMS phase shifter modules 18 are mounted (FIGS. 10 and 11). The transmission lines 142 are electrically coupled to the respective input and output radiating elements 14*a* and 14*b* to carry RF signals to and from the input and output radiating elements 14*a* and 14*b*. In the illustrated exemplary embodiment, the transmission lines 142 are L-shaped, and have one leg extending across the respective slots 36 in the rectangular base portion 34 (FIG. 2) of the respective radiating elements 14*a* and 14*b*. The rectangular base portion 34 functions as a ground plane for the transmission line 142. At the slot 36, there is a break across the ground plane (that is, the rectangular portion 34) which causes a voltage potential, thereby to force RF energy to propagate along the slot 36 of the respective radiating elements 14*a* and 14*b*.

The DC pins 138 also extend through the thickness of the PCB 126 and are electrically connected to DC control signal and bias lines 144. As is shown in FIG. 11, the DC control signal and bias lines 144 branch outward from the middle of the PCB 126 to beyond the footprint of the respective MEMS phase shifter module 18. The DC control signal and bias lines 144 are routed to the other side of the PCB 126 via plated through holes 148 in the PCB 126. The plated through holes 148 form two rows of longitudinally aligned DC column interconnects, the function of which are described in greater detail below. As will be appreciated, the routing and location of the DC control signal and bias lines 144 will be based on such factors as the size and dimensions of the transmission lines 142 and the lattice spacing between the radiating elements 14*a* and 14*b*.

It will be appreciated that the orientation of the RF pins 134 and the DC pins 138 relative to the plane of the housing 130 of the MEMS phase shifter modules 18 enables the RF pins 134 and DC pins 138 to be installed vertically. Such vertical interconnect feature makes installation of the MEMS phase shifter modules 18 relatively simple compared to, for example, conventional MMICS with coaxial connectors or external wire bonds, or other conventional packages having end-to-end type connections requiring numerous process operations. The vertical interconnects provide flexibility in installation, enabling, for example, a surface mount, pin grid array, or BGA type of package.

Figure 13:
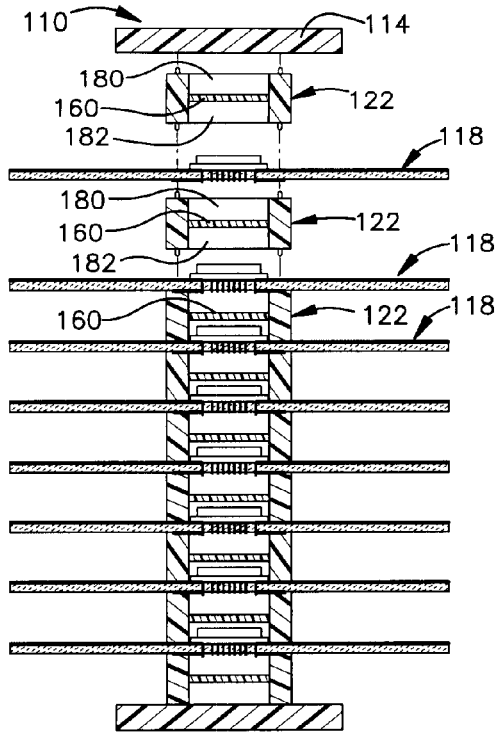
FIG. 13 is an exploded view of the FIG. 7 MEMS steerable electronically scanned lens array antenna in accordance with the present invention.
Figure 14:
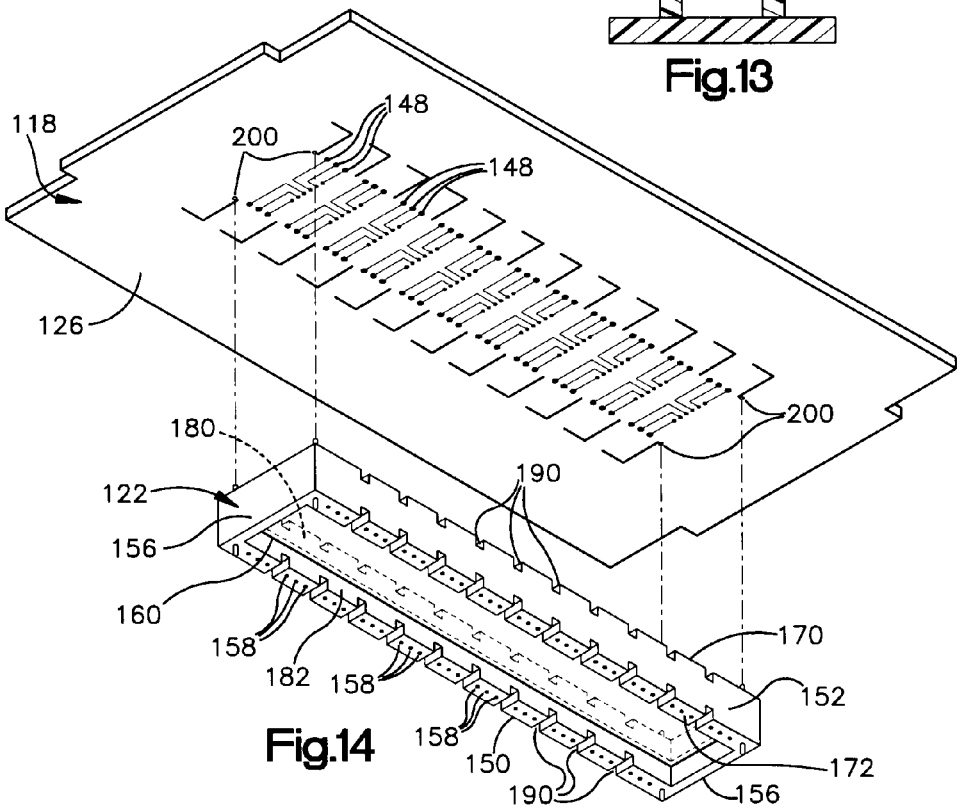
FIG. 14 is a perspective view of one of the spacers of the FIG. 7 MEMS steerable electronically scanned lens array antenna in accordance with the present invention.

The PCB assemblies 118 are stacked vertically and spaced apart by the spacers 122, as is illustrated in FIGS. 13 and 14. More specifically, the PCB assemblies 118 and spacers 122 are stacked in alternating fashion to provide lattice spacing between the radiating elements 14*a* and 14*b* of the PCB assemblies 118. The lattice spacing is based on, for example, the frequency and scanning requirements of the MEMS steerable antenna 110.

The spacers 122 have an elongated rectangular shape and are made of a suitable insulator material such as molded plastic or liquid crystal polymer (LCP). Each spacer 122 includes a front wall 150, a rear wall 152, and a pair of side walls 156. The front and rear walls 150 and 152 each include a plurality of through holes 158 that correspond to the plated through holes 148 in the PCB 126. An intermediate wall 160 is disposed about midway between the top and bottom surfaces 170 and 172 of the front, rear and side walls 150, 152 and 156. On opposite sides of the intermediate wall 160 there are an upper cavity 180 and a lower cavity 182, with the front, rear and side walls 150, 152 and 156 forming the walls of the cavities 180 and 182. The front and rear walls 150 and 152 each include a plurality of notched openings 190 (FIGS. 8 and 14) corresponding to the radiating elements 14*a* and 14*b* that allow RF energy to travel to or from the radiating elements 14*a* and 14*b* during operation of the antenna.

As is shown in FIG. 14, the spacer 122 is positioned lengthwise substantially along the middle of the PCB assembly 118 such that the phase shifter modules 18 are received in the lower cavity 182 of the spacer 122, and the through holes 158 in the front and rear walls 150 and 152 of the spacer 122 align with the pair of longitudinally aligned plated through holes 148 in the PCB 126.

Biasing lines (not shown) are routed through and contained by the spacers 122 via the through holes 158, and are electrically coupled to the aforementioned DC control signal and bias lines 142 via the plated through holes 148 of the PCB assemblies 118. In an embodiment, the biasing lines include compressible contacts such as fuzz buttons and pogo pins. The biasing lines are routed to the printed wiring board (PWB) 114, which includes the control circuitry that biases each column of MEMS phase shifter modules 18 thereby to effect scanning in the E-plane.

When sandwiched together, the spacers 122 provide a column support structure for the PCB assemblies 118 and enable column control of the MEMS phase shifter modules 18 thereof. It is noted that each spacer 122, and more particularly the intermediate wall 160 thereof, may be used to clamp the housings 130 of the respective MEMS phase shifter modules 18 to the PCBs 126. Also, as is shown in the illustrated embodiment, the spacers 122 and PCB assemblies 118 may include alignment holes 200 for receiving alignment fasteners such as dowel pins, screws and/or tie rods to facilitate aligning together and clamping in place the stacked spacers 122 and PCB assemblies 118. In an embodiment, the edges of the spacer 122 are metalized to provide electromagnetic shielding. In accordance with the invention, the spacers 122 function as interface hubs for the MEMS steerable electronically scanned lens array antenna 110, providing or facilitating DC bias, RF signal transmission, mechanical alignment and structural load bearing.

Figure 15:
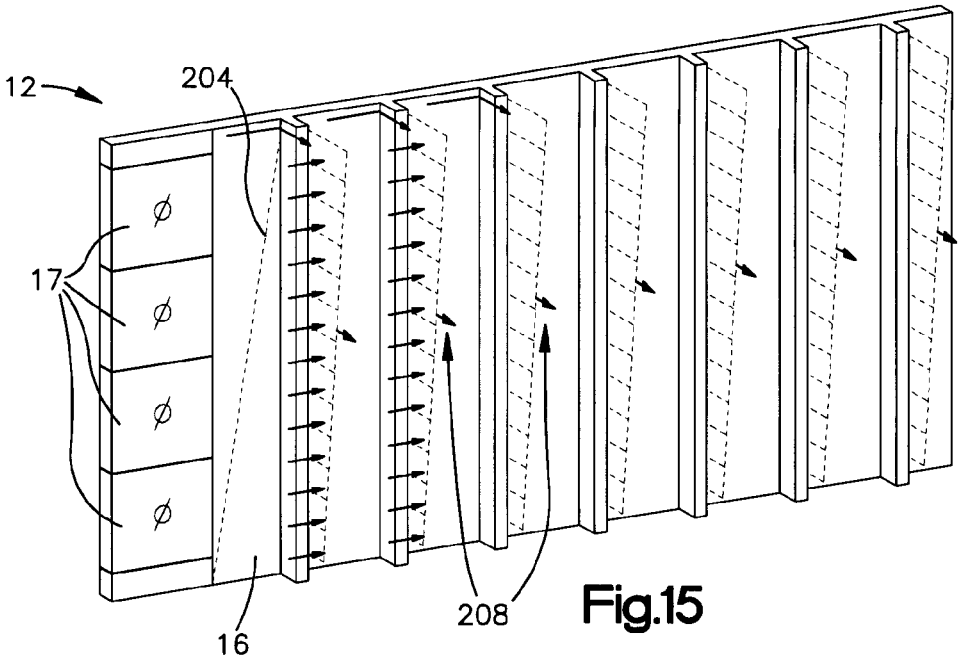
FIG. 15 is perspective view of the MEMS H-plane steerable continuous transverse stub (CTS) electronically scanned feed array of FIG. 3, an incident wavefront being shown via dashed lines, and H-plane scanning via arrows.
Figure 16A:
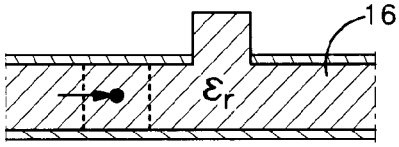
FIGS. 16*a*–16*c* each illustrate a segment of the continuous transverse stub (CTS) electronically scanned feed array of FIG. 15, showing a phase constant thereof.
Figure 16B:
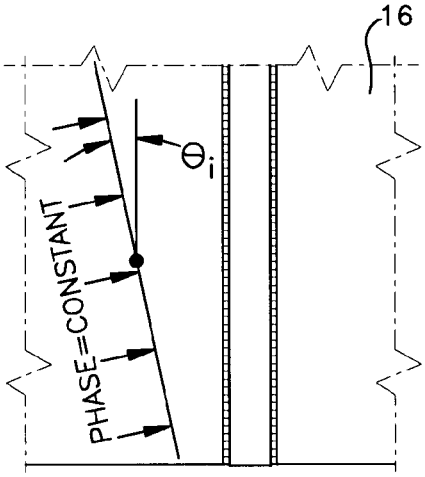
Figure 16C:
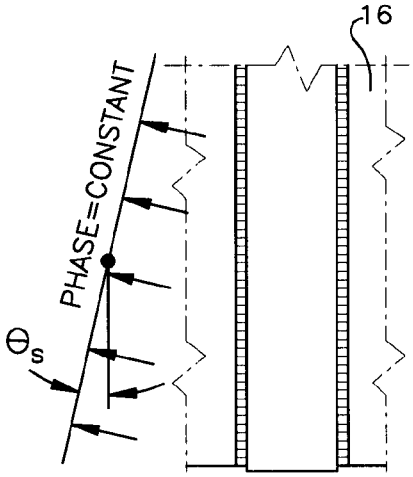
Figure 17:
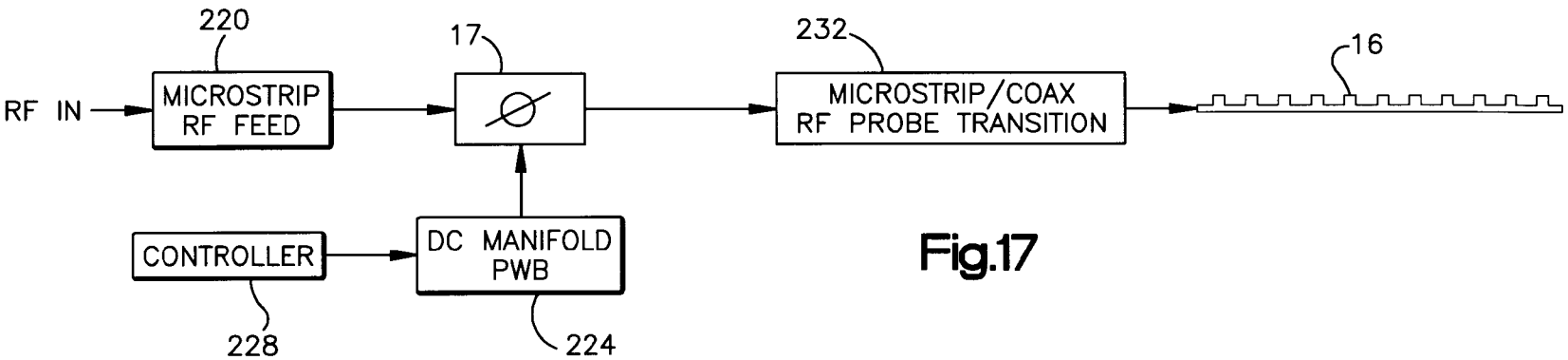
FIG. 17 is a block diagram of a packaging concept of the MEMS H-plane steerable continuous transverse stub (CTS) electronically scanned feed array of FIG. 3.

FIGS. 15–17 show an exemplary means of incorporating one dimensional scanning into the CTS feed aperture of the MEMS H-plane steerable continuous transverse stub (CTS) electronically scanned feed array 12 of FIG. 3. As mentioned above, the phase shifter modules 17 allow the CTS feed array 16 to electronically scan in one dimension in the H-plane. Electronic scanning in the H-plane is accomplished with the application of oblique incidence of the line feed excitation. In FIG. 15, an incident wave front is illustrated via dashed lines 204, and H-plane scanning is illustrated via arrows 208. As is shown in FIG. 16, an oblique incidence of propagating waveguide modes can be used to achieve a variation of incoming phase front relative to the CTS radiator element axis for scanning the beam in the transverse H-plane. In an electronically scanned lens array (ESA), this variation is imposed through electrical variation of the primary line feed exciting the parallel plate region. The particular scan angle $\theta s$ of the scanned beam will be related to the angle of incidence $\theta i$ of the waveguide mode phase front via Snell's Law.

Figure 12:
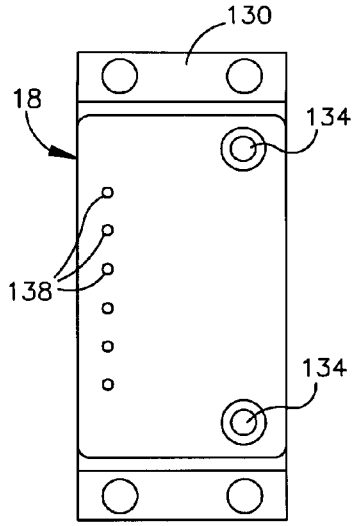
FIG. 12 is an enlarged view of a MEMS phase shifter module in accordance with the present invention.

FIG. 17 shows a block diagram of a packaging concept of an exemplary MEMS steerable CTS 12. A microstrip RF feed 220 with Wilkinson power dividers for example may be used to feed RF signals into the MEMS phase shifter modules 17. The MEMS phase shifter modules 17, in turn, receive DC power from a DC manifold power wiring board (PWB) 224 and are controlled by a controller 228. The CTS feed array 16 receives the RF signals from the MEMS phase shifter modules 17 through a microstrip/coax RF probe transition 232. In an exemplary embodiment of the invention, the phase shifter modules 17 shown in FIG. 12 are mounted onto a metal plate assembly including the microstrip RF feed 220 and the DC manifold PWB 224. In such embodiment, the RF pins and DC pins of the phase shifter modules 17 are routed to the RF and DC vertical interfaces of the microstrip RF feed 220 and the DC manifold PWB 224. The RF and DC vertical interfaces may comprise compressible metal contacts, such as fuzz buttons, that are surrounded by dielectric headers. The dielectric headers are shaped to maintain 50 ohms for RF and to prevent short circuiting the interconnects to the metal plate for RF and DC.

Although the invention has been shown and described with respect to certain illustrated embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention. In addition, while a particular feature of the invention may have been described above with respect to only one of several illustrated embodiments, such feature may be combined with one or more other features of the other embodiments, as may be desired and advantageous for any given or particular application.

The present invention includes all such equivalents and modifications, and is limited only by the scope of the following claims.

What is claimed is:

1. A microelectromechanical system (MEMS) steerable electronically scanned lens array (ESA) antenna, comprising:

a MEMS E-plane steerable lens array including first and second arrays of wide band radiating elements, and an array of MEMS E-plane phase shifter modules disposed between the first and second arrays of radiating elements; and, a MEMS H-plane steerable linear array including a continuous transverse stub (CTS) feed array and an array of MEMS H-plane phase shifter modules at an input of the CTS feed array, the MEMS H-plane steerable linear array being disposed adjacent the first array of radiating elements of the MEMS E-plane steerable lens array for providing a planar wave front in the near field;

wherein the H-plane phase shifter modules shift RF signals input into the CTS feed array based on the phase settings of the H-plane phase shifter modules, and the E-plane phase shifter modules steer a beam radiated from the CTS feed array in an E-plane based on the phase settings of the E-plane phase shifter modules.

2. The MEMS ESA antenna of claim 1, wherein the first and second arrays of wide band radiating elements are fabricated onto a printed circuit board (PCB), and the array of MEMS E-plane phase shifter modules are mounted to the PCB between the first and second wide band radiating elements.

3. The MEMS ESA antenna of claim 1, wherein each MEMS E-plane phase shifter module includes a pair of RF pins corresponding to respective first and second radiating elements of the first and second arrays of radiating elements of the MEMS E-plane steerable lens array.

4. The MEMS ESA antenna of claim 3, wherein the RF pins extend through the thickness of the PCB and electrically connect to respective microstrip transmission lines that are mounted on the side of the PCB opposite to that which the MEMS E-plane phase shifter modules are mounted, the microstrip transmission lines being operative to carry the RF signals to and from the respective first and second radiating elements.

5. The MEMS ESA antenna of claim 1, wherein the array of MEMS E-plane phase shifter modules include two or more rows and at least one column of MEMS E-plane phase shifter modules and each MEMS E-plane phase shifter module includes a plurality of DC pins that electrically connect to respective DC control signal and bias lines, and wherein the two or more rows of MEMS E-plane phase shifter modules are controlled together as a group in column-like fashion via the DC control signal and bias lines so that the two or more MEMS E-plane phase shifter modules along the column receive the same phase setting.

6. The MEMS ESA antenna of claim 5, wherein the at least one column of MEMS E-plane phase shifter modules includes first and second columns of MEMS E-plane phase shifter modules, and wherein the first column of MEMS E-plane phase shifter modules receives a first phase setting and the second column of MEMS E-plane phase shifter modules receives a second phase setting different from the first phase setting.

7. The MEMS ESA antenna of claim 1, wherein each MEMS E-plane phase shifter module includes a pair of RF pins corresponding to respective first and second radiating elements of the first and second arrays of radiating elements of the MEMS E-plane steerable lens array, and a plurality of DC pins for receiving control commands to operate the respective MEMS E-plane phase shifter module, and wherein the RF pins and DC pins are oriented perpendicularly with respect to a housing of the respective MEMS phase shifter module to enable interconnection of same to the PCB in a relatively vertical manner.

8. The MEMS ESA antenna of claim 2, wherein two or more PCBs are vertically arranged in column-like fashion and spaced apart in alternating fashion by spacers to form a lattice structure of rows and columns of first and second radiating elements.

9. The MEMS ESA antenna of claim 8, wherein the lattice spacing is based on the frequency and scanning capabilities of an antenna application.

10. The MEMS ESA antenna of claim 8, wherein the spacers include through holes, and wherein the array of MEMS E-plane phase shifter modules includes two or more rows and at least one column of MEMS E-plane phase shifter modules and each MEMS E-plane phase shifter module includes a plurality of DC pins that electrically connect to respective DC control signal and bias lines that receive control commands to operate the respective MEMS E-plane phase shifter module, and wherein the DC control signal and bias lines from the two or more rows of MEMS E-plane phase shifter modules are routed through and contained by the spacers via the through holes.

11. The MEMS ESA antenna of claim 8, wherein the spacers each include front and rear walls corresponding to the first and second arrays of wide band radiating elements, and the first and second walls include a plurality of notched openings corresponding to the radiating elements that allow RF energy to travel to or from the radiating elements during operation of the MEMS ESA antenna.

12. The MEMS ESA antenna of claim 1, wherein the wide band radiating elements of the MEMS E-plane steerable lens array are oriented such that E-plane scanning occurs parallel to the rows of radiating elements.

13. A method of frequency scanning radio frequency energy, comprising the steps of:

inputting radio frequency (RF) energy into an array of MEMS H-plane phase shifter modules;

adjusting the phase of the RF energy based on the phase settings of the MEMS H-plane phase phase shifter modules;

radiating the H-plane phase adjusted RF signals through a plurality of CTS radiating elements in the form of a plane wave in the near field;

emitting the H-plane phase adjusted RF plane wave into an input aperture of a MEMS E-plane steerable lens array including an array of MEMS E-plane phase shifter modules;

converting the RF plane wave into discrete RF signals;

adjusting the phase of the discrete RF signals based on the phase settings of the MEMS E-plane phase shifter modules; and radiating the H-plane and E-plane adjusted RF signals through a radiating aperture of the MEMS E-plane steerable lens array, thereby recombining the RF signals and forming an antenna beam.

14. The method of claim 13, further including varying the frequency of the RF signal inputted into the CTS feed array thereby to change the angular position of the antenna beam in the E-plane of the MEMS E-plane steerable lens array and to effect frequency scanning by the antenna beam.

15. The method of claim 13, wherein the step of inputting RF energy includes feeding the CTS radiating elements in series.

16. The method of claim 13, further including the step of adjusting the phase shifter output for the respective MEMS E-plane phase shifter modules by adjusting the bias of one or more MEMS phase shifter switches in the respective MEMS E-plane phase shifter modules.

17. The method of claim 13, wherein the array of MEMS E-plane phase shifter modules includes at least one column of two rows of MEMS E-plane phase shifter modules, and wherein the step of adjusting the phase shifter output for the respective MEMS E-plane phase shifter modules is conducted in a column-like fashion.

* * * * *